US006246321B1

(12) United States Patent
Rechsteiner et al.

(10) Patent No.: US 6,246,321 B1
(45) Date of Patent: Jun. 12, 2001

(54) MOVEMENT DETECTOR

(75) Inventors: Martin Rechsteiner, Männedorf; Hansjürg Mahler, Hombrechtikon, both of (CH)

(73) Assignee: Siemens Building Technologies AG, Mannedorf (CH)

( * ) Notice: Subject to any disclaimer, the term of this patent is extended or adjusted under 35 U.S.C. 154(b) by 0 days.

(21) Appl. No.: 09/346,515

(22) Filed: Jul. 1, 1999

(30) Foreign Application Priority Data

Jul. 6, 1998 (EP) ..... 98112460

(51) Int. Cl.[7] ..... G08B 19/00

(52) U.S. Cl. ..... 340/522; 340/565; 340/567; 340/584; 340/587; 348/164; 396/61; 382/103; 250/338.1; 250/342

(58) Field of Search ..... 340/522, 565, 340/567, 584, 587, 588, 589; 356/326; 348/164, 162, 165, 166, 169, 143, 154, 155, 172, 148; 396/61, 65, 168; 382/103; 342/53; 250/338.1, 342; 346/107

(56) References Cited

U.S. PATENT DOCUMENTS

| | | | | |
|---|---|---|---|---|
| 4,905,292 | * | 2/1990 | Wentworth et al. | 382/103 |
| 5,077,548 | * | 12/1991 | Dipoala | 340/522 |
| 5,331,308 | * | 7/1994 | Buccola et al. | 340/522 |
| 5,657,076 | | 8/1997 | Tapp | 348/154 |
| 5,701,117 | * | 12/1997 | Platner et al. | 340/567 |
| 5,870,022 | * | 2/1999 | Kuhnly et al. | 340/567 |
| 5,877,688 | * | 3/1999 | Morinaka et al. | 340/584 |
| 5,966,074 | * | 10/1999 | Baxter | 340/565 |
| 6,069,696 | * | 5/2000 | McQueen | 356/326 |
| 6,101,333 | * | 8/2000 | Bullitt et al. | 396/61 |

FOREIGN PATENT DOCUMENTS 0432680 6/1991 (EP) ..... G08B/17/12

OTHER PUBLICATIONS

Arlowe H. Duane et al., "The Mobile Intrusion Detection and Assessment System (Midas)" proceedings of the International Carnahan Conference on Security Technology: Crime Countermeasures, Lexington, Oct. 10–12, 1990.

Sunetra K. Mendis et al., "A 128 X 128 CMOS Active Pixel Image Sensor for Highly Integrated Imaging Systems," IEDM 93–538.

R. H. Nixon et al., "128 X 128 CMOS Photodiode–Type Active Pixel Sensor With On–Chip Timing, Control and Signal Chain Electronics," SPIE vol. 2415/117.

* cited by examiner

*Primary Examiner*—Benjamin C. Lee
(74) *Attorney, Agent, or Firm*—BakerBotts L.L.P.

(57) ABSTRACT

A device having an image-providing sensor, hereinafter designated as "image sensor," operating in the visible and near-infrared range, an thermal image-providing sensor, hereinafter designated as "thermal-image sensor," operating in the thermal radiation range and having a lower resolution than the image sensor, and an electronic evaluation system. The evaluation system determines whether one or both of the signals generated by the sensors are used for determining whether an alarm condition exists. As a result, the detectability of low-contrast objects is increased, the false alarm rate is reduced, and object classification is made possible.

32 Claims, 2 Drawing Sheets

MOVEMENT DETECTOR

PRIORITY APPLICATION

This application claims priority to European Application No. 98 112 460.5 filed on Jul. 6, 1998, and entitled "Bewegungsmelder," by Martin Rechsteiner and Hansjürg Mahler, which is hereby incorporated by reference.

FIELD OF THE INVENTION

The invention relates in general to the field of electronic surveillance and intrusion detection. More particularly, the present invention relates to a movement detector having dual image sensors and an electronic evaluation system for using signals generated by the sensors to determine the location, movement and classification of moving objects.

BACKGROUND OF THE INVENTION

Conventional passive infrared (PIR) sensors are predominantly used in movement detectors, but although they are very inexpensive, they do not provide any spatial resolution and have difficulty detecting objects having low temperature contrasts as compared to their surroundings. Doppler detectors or movement detectors using the PIR principle and the Doppler principle also do not provide any spatial resolution. It is precisely this property, however, which is required not only for determining whether an object is located in a room under surveillance, but also for determining where the object is located in the room, in which direction it is moving, and the type or class of object concerned.

An obvious use of so-called "thermal-image sensors," i.e., image-providing sensors operating in the wavelength region of about 5 to 15 $\mu$m, is undesirable in that conventional thermal-image sensors are so expensive that sufficiently high-resolution sensors cannot be used for movement detectors. As such, high resolution applications using thermal-image sensors are not practical.

Additionally, images of objects taken with conventional low-resolution thermal-image sensors, having in the range of about 4×4 pixels up to 32×32 pixels, often cannot be analyzed precisely enough for the required application. For example, such a resolution would be too low for distinguishing humans from non-human animals. Also, conventional thermal-image sensors have a low detection sensitivity for low temperature contrast at ambient temperatures around 30° C.

So-called "image sensors" are also known, which are image-providing sensors operating in the visible and near-infrared range, particularly in the wavelength range from about 0.4 to 1.8 $\mu$m. Conventional image sensors are inexpensive and widely used, but are generally used in environments having a minimal level of brightness. These sensors suffer the shortcoming that they are unable to function properly in the dark unless combined with a lighting system. In addition, to evaluate the signal of a conventional image sensor, the entire image always has to be processed, which requires a relatively high expenditure of memory capacity and computer processing time and, if the evaluation is not carried out locally, requires an expensive transmission of data across a communications media.

If low-resolution image sensors or those having the possibility of reading-out images with reduced resolution are used there is the risk that low contrast objects may be blurred and can therefore no longer be detected.

SUMMARY OF THE INVENTION

The above-described limitations and inadequacies of conventional movement detectors are substantially overcome by the present invention, in which a primary objective is to provide a movement detector that is fully usable even in the dark, which can operate with as little memory capacity and computer time as possible, with which low-contrast objects can also be reliably detected, and which has a spatial resolution which is sufficient for the detection and analysis of objects. The movement detector is intended not only to fulfill all the known criteria of burglary detection technology, but it is also intended to permit classification of the moving objects.

The movement detector of the present invention has an image-providing sensor, hereinafter designated as an "image sensor," operating in the visible and near-infrared range, and an image-providing sensor, hereinafter designated as a "thermal-image sensor," operating in the thermal radiation range and having a lower resolution than the image sensor, and wherein an electronic evaluation system receives corresponding image signals from the image and thermal-image sensors and performs a combined evaluation of the image signals to determine whether an alarm condition exists. The evaluation system determines whether one or both of the received image signals are to be evaluated to determine whether an alarm condition exists.

As a result of using image signals from a low resolution thermal-image sensor with signals from a higher resolution image sensor, the respective weaknesses of the two types of sensors can be compensated for, which increases the detectability of low-contrast objects and decreases the false-alarm rate. In addition, object classification is possible without using an expensive high-resolution thermal-image sensor.

The thermal-image sensor may measure either the absolute temperature or, with suitable differential interconnections of the individual sensor elements, temperature changes. Polyethylene Fresnel lenses can be used for low-resolution thermal-image sensors, and these are substantially cheaper than the high-quality zinc selenide lenses required for high resolution thermal-image sensors.

In a first preferred embodiment of the movement detector according to the present invention, prior to the evaluation of the signals of the sensors, a separate preliminary evaluation of the signals is carried out both for the image sensor and for the thermal-image sensor.

In a second preferred embodiment of the movement detector according to the present invention, the thermal-image sensor carries out an illumination-independent detection and approximate localization of moving objects, and the image sensor carries out a classification of the objects.

In a third preferred embodiment of the movement detector according to the present invention, the image sensor is formed by a pixel-wise addressable sensor, preferably an active pixel sensor. The pixel-wise addressable image sensor has the advantage that the reading-out can always be restricted to the image region of interest. Analysis of the image region, as opposed to the entire image, saves computer time and memory capacity and, in the case of non-local evaluation, transmission time.

In a fourth preferred embodiment of the movement detector according to the present invention, means for brightness measurement and for controlling the exposure time of the image sensor and/or temperature measurement means are provided and are connected to the electronic evaluation system.

In a fifth preferred embodiment of the movement detector according to the present invention, the detector can be operated in various operating modes adapted to the requirements of particular applications, and in addition, has various signal evaluation modes, wherein the selection of a evaluation mode takes place on the basis of the ambient or background conditions, preferably on the basis of the brightness and/or temperature measured by the aforementioned brightness measurement and/or temperature measurement.

The use of the means for brightness measurement and/or for temperature measurement has the advantage that the detector can determine the most important parameters in its surroundings and can set a suitable evaluation mode on the basis of the above-mentioned ambient conditions.

Further objects, features and advantages of the invention will become apparent from the following detailed description taken in conjunction with the accompanying figures showing illustrative embodiments of the invention.

BRIEF DESCRIPTION OF THE DRAWINGS

The invention is explained in greater detail below by reference to the drawings, in which.

DETAILED DESCRIPTION OF THE PREFERRED EMBODIMENTS

Figure 1:
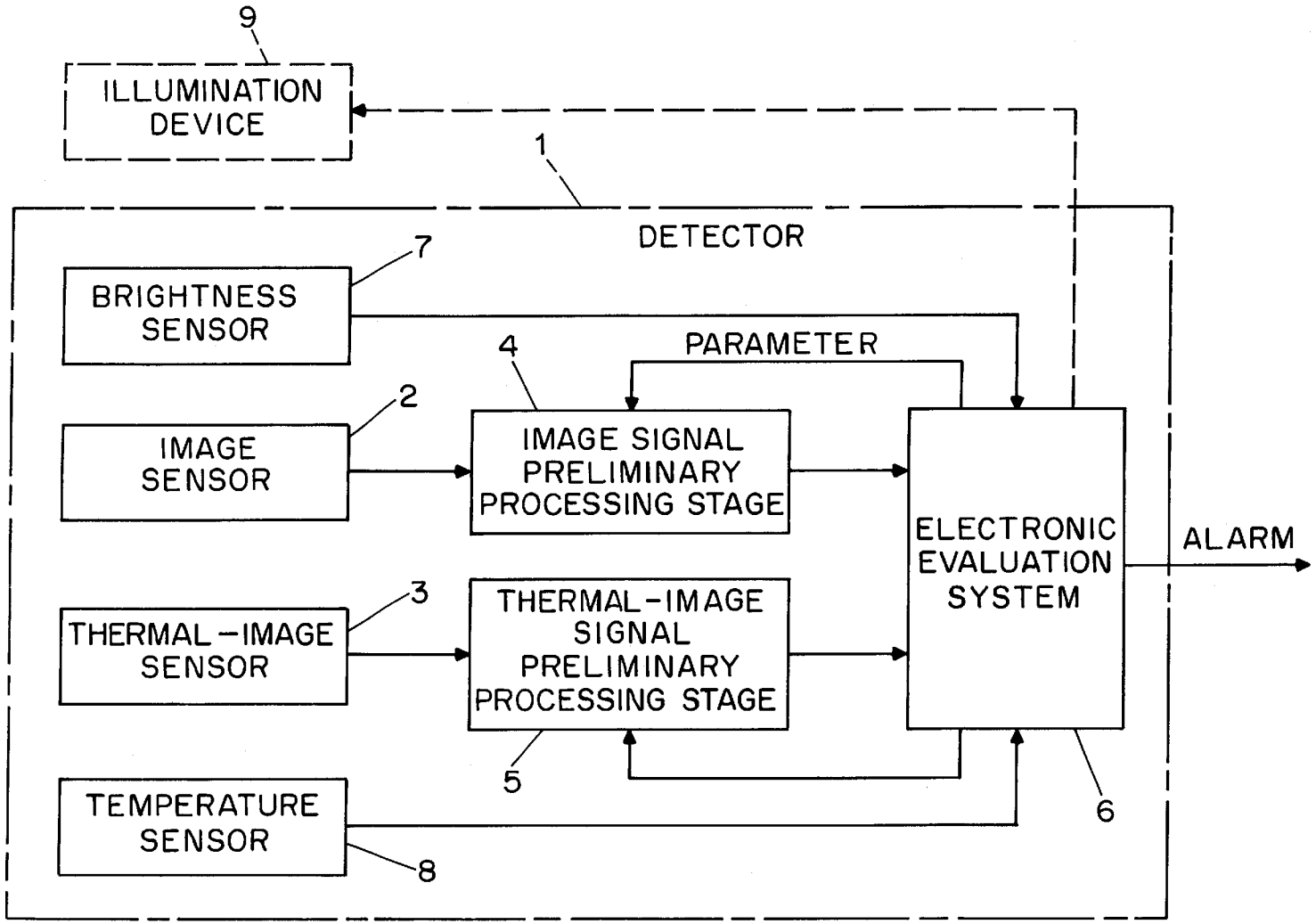
FIG. 1 is a block diagram of a movement detector according to a preferred embodiment of the present invention.

FIG. 1 shows a block diagram of a movement detector according to a preferred embodiment of the present invention. The intrusion or movement detector 1 includes a first image-providing sensor 2, hereinafter designated as an "image sensor," operating in the visible wavelength range from about 0.4 to 1.8 $\mu$m, a second sensor 3, hereinafter designated as a "thermal-image sensor," operating in the thermal radiation wavelength range from about 5 to 15 $\mu$m, visible image signal and thermal image signal preliminary processing stages 4 and 5, respectively, being connected downstream of each of the two sensors, and an electronic evaluation system 6 for processing and evaluating the preliminary processed signals of the two sensors 2 and 3. The image and thermal-image sensors 2 and 3 are constructed and arranged so as to have the same field-of-view in the room under surveillance, and the evaluation system 6 includes a first evaluation section for evaluating the image signal from the first image sensor 2 and a second evaluation section for evaluating the image signal from the second image sensor 3. As shown in FIG. 1, the detector 1 further includes a brightness-measuring sensor 7 and temperature-measuring sensor 8, the brightness measurement preferably being performed by the image sensor 2 itself.

Because humans and animals typically have a good temperature contrast with respect to the background, the thermal-image sensor 3 is very well suited for illumination-independent detection and approximate localization of moving objects. Due to its higher resolution, the image sensor 2 can, in turn, classify the objects and, in particular, differentiate people from animals. The image sensor 2 compensates for the detection weakness of the thermal-image sensor 3 for low temperature contrast.

The image sensor 2 is preferably formed by a pixel-wise addressable sensor, for example a so-called active pixel sensor (APS), which is especially suited for very low current consumption and access of individual pixels. Furthermore, additional application-specific analog or digital functions, for example simple image-processing algorithms such as filters, illumination control and the like, can easily be integrated in such an APS. Regarding APS devices, reference is made to the articles entitled "A 128×128 CMOS Active Pixel Image Sensor for Highly Integrated Imaging Systems" by Sunetra K. Mendis, Sabrina E. Kennedy and Eric R. Fossum, IEDM 93-538, and "128×128 CMOS Photodiode-Type Active Pixel Sensor with On-Chip Timing, Control and Signal Chain Electronics" by R. H. Nixon, S. E. Kemeny, C. O. Staller and E. R. Fossum in SPIE Vol. 2415/117, which are hereby incorporated by reference.

The image sensor 2 is directed at the room under surveillance, detects an object in image form, and digitizes the image. If the APS forming the image sensor 2 comprises, for example, 128×128 pixels, an area of approximately 12×12 cm at a distance of 15 m in front of the image sensor 2 would correspond to one pixel if a suitable wide-angle optical system is used. Such a resolution makes it possible to distinguish human and animal figures relatively reliably from one another. A higher resolution can increase the reliability of the image sensor 2, but in turn requires greater computer processing capability.

When the detector 1 is operated, the image sensor 2 makes an image of the room under surveillance at intervals of fractions of a second and stores it for a short time so that it can be compared with a reference image which is continuously updated. This image comparison can be performed either by the image sensor 2 itself or the corresponding preliminary processing stage 4. Images recorded by the image sensor 2 generating an alarm decision can be stored in computer memory (not shown).

The thermal-image sensor 3, which has a relatively low resolution of, for example, 4×4 pixels up to about 32×32 pixels, and comprises a matrix of an appropriate number of thermally sensitive elements, substantially serves to compensate for the potential shortcomings of the image sensor 2, in particular its property of providing no image information below a critical illumination level. In general, the robustness and immunity to false alarms of the detector 1 is quite substantially increased compared to existing movement detectors by combined processing of the signals of the two sensors 2 and 3.

The brightness and temperature sensors 7 and 8 provided in the detector 1 continuously measure the brightness of the room and temperatures of the object and room and, on the basis of the values measured, set the suitable evaluation mode of the detector 1, which determines how the signals of the two sensors 2 and 3 are evaluated. The brightness-measuring means 7 can simultaneously be used to control the exposure time. The detector 1 can, in addition, be operated in various operating modes which are adapted to the requirements of the particular application and/or to the existing infrastructure (for example, level of risks, presence of animals, illumination triggers).

Figure 2:
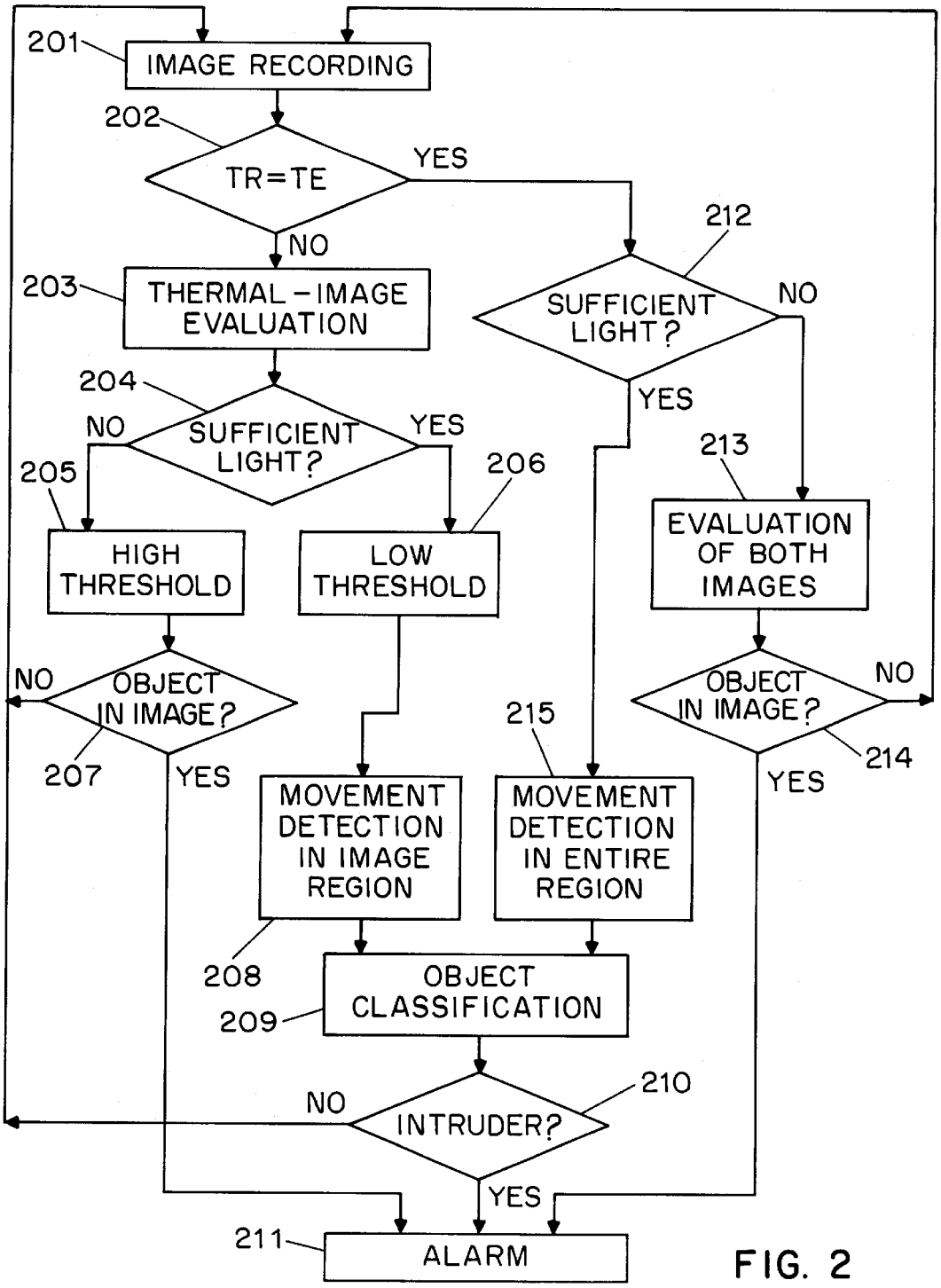
FIG. 2 is a flow diagram of a method performed by the electronic evaluation system of FIG. 1.

FIG. 2 shows a flow diagram for a method performed by the electronic evaluation system 6 of FIG. 1. The flow diagram shows situations under which the movement detector of FIG. 1 generates an alarm decision. In a preferred method of the present invention, generation of the alarm decision depends on a plurality of evaluation modes determined by, for example, the difference between the room temperature $T_R$ and the body temperature $T_B$, and the level of room brightness.

As shown in FIG. 2, the movement detector first records both visible and thermal images (step 201). If the room (background) temperature $T_R$ differs sufficiently from the body (object) temperature $T_B$ (step 202), the detector performs a thermal-image evaluation of the recorded thermal image (step 203), which in turn triggers the evaluation of the recorded visible image. The detection threshold or response threshold of the thermal-image sensor 3 is dependent on the brightness of the room. If the brightness of the room is sufficient (step 204), the detection threshold corresponding to the thermal image sensor 3 is set very low (step 206). If the evaluation section for the thermal-image sensor 3 detects an object, its size and coordinates are determined and conveyed to the image-sensor evaluation section, which in turn generates an output corresponding only to an image portion (region) of interest and not the entire image, thereby saving computer time and power. The image portion output is subjected to a movement detection processing step (step 208) and an object classification step (step 209). If an object is classified as a human being (step 210), the detector triggers an alarm (step 211). If the brightness of the room is inadequate (step 204), the thermal-image evaluation section employs a high detection threshold (step 205) and, if the latter is exceeded, triggers an alarm directly (step 211) based solely upon the presence of a detected object in the thermal image (step 207).

Referring again to FIG. 2, if the difference between $T_R$ and $T_B$ is insufficient (step 202), the (visible) image signal evaluation section is used to determine whether an alarm condition exists. If the room (background) brightness is determined to be sufficient (step 212), then a movement detection processing step (step 215) is performed using the entire visible image. The object classification step (step 209) is then performed to determine whether an intruder is present. If an intruder is present (step 210), the alarm decision is generated (step 211).

If, however, the brightness of the room is determined to be inadequate (step 212), both evaluation sections evaluate the corresponding recorded images and the results are processed (step 213). The recorded image signals of both sensors 2 and 3 are evaluated in each case over the entire image (step 214). If an object is detected in one or both recorded images, then the alarm decision is generated (step 211).

The detectability of objects in the image, e.g., steps 207, 208, 215 and 214, can be improved by long exposure times or averaging over a plurality of images. Although very rapid operations are more difficult to detect as a result, such operations are also very unlikely in the situation where there is inadequate room brightness and the difference between $T_R$ and $T_B$ is low.

Alternatively, the detector 1 can activate an illumination in the visible spectrum, or, if discrete surveillance is desired, in the near-infrared, wherein the illumination can be activated either on the basis of the measured environmental conditions (unduly low temperature contrast and unduly low brightness) or, alternatively, if one of the two sensors provides a very weak signal.

According to another preferred embodiment of the present invention, an assisting external illumination, for example a room illumination, external illumination, or a spot light, can be switched on by the detector I via, e.g., radio, infrared, direct wire connection, a network, or via an existing building bus. Furthermore, an illumination can be specially provided for, and can be incorporated either into the detector or made available as an accessory appliance. The illumination can be activated by the electronic evaluation system 6. An illumination incorporated in the detector could, for example, be formed by infrared light emitting diodes (LEDs).

It has been found that it is advantageous to subject the signals of the image sensor 2 and of the thermal-image sensor 3 to a separate preliminary evaluation prior to the evaluation by the electronic evaluation system 6, the preliminary evaluation taking place in the preliminary processing stages 4 and 5, respectively. It is also possible to integrate the preliminary processing stages in the electronic evaluation system 6. During the preliminary evaluation, the signals of the thermal-image sensor 3 are converted into a format suitable for evaluation with the signals of the image sensor 2, and are graded according to their strength. The number of pixels altered with respect to time, and their coordinates, are determined. In the case of the image sensor 2, the preliminary evaluation can be integrated as hardware and/or in the form of a processor core on the APS chip. During the preliminary evaluation, the number of pixels altered with respect to the reference image, their clustering, and features of the pixel clustering are determined.

The image sensor 2 can be designed so that images resulting in an alarm decision and the images immediately preceding and/or following the alarm decision can be temporarily stored. Optionally, these stored images can be transmitted to a non-local station.

Although the present invention has been described in connection with particular embodiments thereof, it is to be understood that various modifications, alterations and adaptations may be made by those skilled in the art without departing from the spirit and scope of the invention. It is intended that the invention be limited only by the appended claims.

What is claimed is:

1. A device for detecting the movement of an object, comprising, a first image sensor responsive to visible and near infrared radiation, and generating a first image signal representative of the object, said first image sensor being a pixel-wise addressable sensor;

a second image sensor having a resolution lower than said first image sensor for detecting a second radiation type emitted by the object, and generating a second image signal representative of the object, said second image sensor being a low resolution thermal-image sensor; and an evaluation system responsive to the first and second image signals and determining whether one or both of the received image signals are to be evaluated for determining whether an alarm condition exists.

2. The device according to claim 1, wherein said second sensor performs an illumination-independent detection and approximate localization of the object, and wherein said first sensor performs a classification of the object.

3. The device according to claim 1, further comprising:

a first preprocessing stage coupling said first image sensor and said evaluation system; and a second preprocessing stage coupling said second image sensor and said evaluation system, wherein said first and second image signals are separately evaluated by the first and second preprocessing stages, respectively, prior to processing by said evaluation system.

4. The device according to claim 1, wherein said pixel-wise addressable sensor comprises an active pixel sensor.

5. A device for detecting the movement of an object, comprising:

a first image sensor for detecting a first radiation type emitted by the object and for generating a first image signal representative of the object;

a second image sensor having a resolution lower than said first image sensor for detecting a second radiation type emitted by the object, and generating a second image signal representative of the object;

an evaluation system for receiving the first and second image signals and determining whether one or both of the received image signals are to be evaluated for determining whether an alarm condition exists;

a brightness sensor coupled to said evaluation system for measuring a background brightness; and a temperature sensor coupled to said evaluation system for measuring a background temperature ($T_R$) and the temperature ($T_B$) of the object, said evaluation system evaluating at least one of said first and second image signals in response to at least one of said brightness sensor and temperature sensor.

6. The device according to claim 5, wherein brightness sensor controls an exposure time of said first image sensor.

7. The device according to claim 5, wherein said evaluation system comprises a plurality of image signal evaluation modes dependent at least in part on the measured values of $T_R$ and $T_B$.

8. The device according to claim 5, wherein said evaluation system first evaluates the second image signal when $T_R$ is sufficiently different than $T_B$.

9. The device according to claim 8, further wherein said evaluation system defines a portion of the second image signal corresponding to the object, and then evaluates a portion of the first image signal corresponding to the portion of the second image signal to detect the movement of the object when the background brightness is sufficiently high.

10. The device according to claim 8, wherein said evaluation system evaluates only the second image signal when the measured background brightness is insufficient.

11. The device according to claim 5, wherein said evaluation system evaluates only the first image signal when the difference between $T_R$ and $T_B$ is insufficient and the measured background brightness is sufficient.

12. The device according to claim 5, wherein said evaluation system evaluates both said first and second image signals when the difference between $T_R$ and $T_B$ is insufficient and the measured background brightness is insufficient.

13. The device according to claim 5, further comprising an illumination device.

14. The device according to claim 13, wherein said illumination device is coupled to said evaluation system and is controlled by said brightness sensor.

15. The device according to claim 1, further comprising a memory for storing image information from said first image sensor corresponding to an alarm decision.

16. A method for electronic surveillance comprising:

detecting an object with a first image sensor sensitive to a first type of radiation;

detecting the object with a second image sensor sensitive to a second type of radiation, the second image sensor having a resolution lower than that of the first image sensor;

generating a first image signal representing the object from the first image sensor;

generating a second image signal representing the object from the second image sensor;

determining whether one or both of the image signals are to be evaluated to determine whether an alarm condition exists;

measuring a background brightness;

measuring a background temperature ($T_R$);

measuring the temperature of the object ($T_B$), and evaluating one or both of the image signals to determine whether the alarm condition exists, wherein said step of determining whether one or both of the image signals are to be evaluated depends at least in part on the measured values of $T_R$ and $T_B$.

17. The method according to claim 16, further comprising the step of preprocessing one or both of the first and second image signals.

18. The method according to claim 16, further comprising:

performing an illumination-independent detection and approximate localization of the object; and classifying the object.

19. The method according to claim 16, wherein said step of determining whether one or both of the image signals are to be evaluated comprises:

determining whether the difference between $T_R$ and $T_B$ is sufficiently high;

determining whether the background brightness is sufficiently high; and if the difference between $T_R$ and $T_B$ is sufficiently high and the background brightness is insufficiently high, using only the second image signal to determine whether the alarm condition exists.

20. The method according to claim 19, further comprising:

setting a detection threshold corresponding to the second image sensor higher than a detection threshold corresponding to a sufficiently high background brightness; and determining whether the object is present from the second image signal.

21. The method according to claim 16, wherein said step of determining whether one or both of the image signals are to be evaluated comprises:

determining whether the difference between $T_R$ and $T_B$ is sufficiently high;

determining whether the background brightness is sufficiently high; and if the difference between $T_R$ and $T_B$ is sufficiently high and the background brightness is sufficiently high, using a portion of the second image signal to determine whether the alarm condition exists.

22. The method according to claim 21, further comprising:

setting a detection threshold corresponding to the second image sensor lower than a detection threshold corresponding to an insufficiently high background brightness;

detecting the movement of the object from a portion of the first image signal corresponding to the portion of the second image signal;

classifying the object; and determining the presence of an intruder.

23. The method according to claim 22, further comprising:

determining the position of the object from the portion of the second image signal;

determining the size of the object from the portion of the second image signal; and defining the corresponding portion of the first image signal on the basis of the position and size of the object.

24. The method according to claim 16, wherein said step of determining whether one or both of the image signals are to be evaluated comprises:

determining whether the difference between $T_R$ and $T_B$ is sufficiently high;

determining whether the background brightness is sufficiently high; and if the difference between $T_R$ and $T_B$ is insufficiently high and the background brightness is sufficiently high, using only the first image signal to determine whether the alarm condition exists.

25. The method according to claim 24, further comprising:

detecting the movement of the object;

classifying the object; and determining the presence of an intruder.

26. The method according to claim 16, wherein said step of determining whether one or both of the image signals are to be evaluated comprises:

determining whether the difference between $T_R$ and $T_B$ is sufficiently high;

determining whether the background brightness is sufficiently high; and if the difference between $T_R$ and $T_B$ is insufficiently high and background brightness is insufficiently high, using both the first and second image signals to determine whether the alarm condition exists.

27. The method according to claim 26, further comprising the step of determining whether the object is present in either one or both of the first and second image signals.

28. The method according to claim 16, further comprising the step of illuminating a region covered by at least one of the image sensors.

29. The method according to claim 16, further comprising the step of performing a separate preliminary evaluation of one or both of the first and second image signals prior to the step of determining whether one or both of the image signals are to be evaluated.

30. The method according to claim 16, further comprising the step of storing, in memory, information from the first image sensor corresponding to an alarm decision.

31. A device for detecting the movement of an object, comprising, a first image sensor for detecting a first radiation type emitted by the object, and for generating a first image signal representative of the object;

a second image sensor for detecting a second radiation type emitted by the object, and for generating a second image signal representative of the object; and an evaluation system for receiving the first and second image signals and for determining whether an alarm condition exists, said evaluation system comprising means for selecting an appropriate evaluation mode by which one or both of the received image signals are evaluated to determine whether the alarm condition exists, said evaluation system further comprises:

means for processing only the second image signal to determine whether the alarm condition exists;

means for processing the second image signal and a portion of the first image signal to determine whether the alarm condition exists;

means for processing only the first image signal to determine whether the alarm condition exists; and means for processing the entirety of both the first and second image signals to determine whether the alarm condition exists.

32. The device according to claim 31, further comprising:

a brightness sensor coupled to said evaluation system for measuring a background brightness; and a temperature sensor coupled to said evaluation system for measuring a background temperature ($T_R$) and the temperature ($T_B$) of the object, wherein the background brightness, $T_R$ and $T_B$ are used by said evaluation system to determine whether the alarm condition exists.

* * * * *